US009039394B2

(12) United States Patent
Iwamoto et al.

(10) Patent No.: US 9,039,394 B2
(45) Date of Patent: May 26, 2015

(54) CEILING FAN WITH SUSPENSION DETECTION

(75) Inventors: Kiyohiko Iwamoto, Aichi (JP); Tetsuji Kawazu, Aichi (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 297 days.

(21) Appl. No.: 13/695,442

(22) PCT Filed: May 18, 2011

(86) PCT No.: PCT/JP2011/002756

§ 371 (c)(1), (2), (4) Date: Oct. 31, 2012

(87) PCT Pub. No.: WO2011/148593

PCT Pub. Date: Dec. 1, 2011

(65) Prior Publication Data

US 2013/0045103 A1 Feb. 21, 2013

(30) Foreign Application Priority Data

May 28, 2010 (JP) ..... 2010-122572

(51) Int. Cl.

*F04D 29/60* (2006.01)
*F04D 25/08* (2006.01)
*F04D 27/00* (2006.01)

(52) U.S. Cl.

CPC ..... *F04D 25/088* (2013.01); *F04D 27/008* (2013.01); *F04D 29/601* (2013.01)

(58) Field of Classification Search

CPC ..... F04D 25/088; F04D 29/60; F04D 29/601; F04D 27/001; F04D 27/008

USPC ..... 417/360, 423.7, 423.15, 424.1; 200/50.1, 40.28, 50.31, 41 R, 51.09; 439/188

See application file for complete search history.

(56) References Cited

U.S. PATENT DOCUMENTS 8,241,017 B2 * 8/2012 Yamamoto et al. ..... 417/423.1
2009/0152086 A1 6/2009 Hisamune et al.

(Continued)

FOREIGN PATENT DOCUMENTS

CN 101465233 6/2009
JP 63-21796 2/1988

(Continued)

OTHER PUBLICATIONS

International Search Report of PCT Application No. PCT/JP2011/002756 dated Aug. 30, 2011.

(Continued)

*Primary Examiner* — Devon Kramer
*Assistant Examiner* — Patrick Hamo
(74) *Attorney, Agent, or Firm* — Panasonic Patent Center

(57) ABSTRACT

A ceiling fan includes a suspending part fixed to a ceiling and a ceiling fan body suspended via the suspending part. The ceiling fan body has a plurality of horizontally-provided blades, a motor that rotates the blades, a shaft protruding from an upper side of the motor, and a joint part that is fixed to an upper side of the shaft and is connected to the suspending part. The joint part is detachable from the suspending part and is provided with a suspension detecting part extending from the joint part to the suspending part. The suspension detecting part detecting an energized state between the suspending part and the joint part.

7 Claims, 7 Drawing Sheets

(56) References Cited

U.S. PATENT DOCUMENTS

| | | | | |
|---|---|---|---|---|
| 2010/0040494 | A1* | 2/2010 | Yamamoto et al. | 417/423.7 |
| 2011/0002783 | A1 | 1/2011 | Yamamoto et al. | |

FOREIGN PATENT DOCUMENTS

| | | |
|---|---|---|
| JP | 03-294696 | 12/1991 |
| JP | 06-088596 | 3/1994 |
| JP | 11-210680 | 8/1999 |
| JP | 2003-207163 | 7/2003 |
| WO | 2009/110201 | 9/2009 |

OTHER PUBLICATIONS

English Translation of Chinese Search Report dated Dec. 3, 2014 for the related Chinese Patent Application No. 201180026427.3.

* cited by examiner

CEILING FAN WITH SUSPENSION DETECTION

TECHNICAL FIELD

The present invention relates to a ceiling fan.

BACKGROUND ART

A conventional ceiling fan includes an attachment fixture (suspending part) fixed with a wire (for example, PTL 1) to prevent the ceiling fan body from falling.

However, the conventional ceiling fan has a difficulty in reliably confirming whether or not a ceiling fan body is properly suspended from a suspending part. That is, in an attachment site of the ceiling fan, the suspending part is fixed to a ceiling, and the ceiling fan body is suspended from the suspending part. It is visually confirmed whether or not the ceiling fan body is properly suspended from the suspending part. Therefore, the ceiling fan may be attached at a high position depending on the place, and in the case of a dark place, it may be wrongly confirmed that the ceiling fan body is properly suspended from the suspending part. Alternatively, the operator may fail to confirm whether or not the ceiling fan body is properly suspended from the suspending part.

CITATION LIST

Patent Literature

PTL 1: Unexamined Japanese Patent Publication No. 6-88596

SUMMARY OF THE INVENTION

A ceiling fan of the present invention includes a suspending part fixed to a ceiling, and a ceiling fan body suspended via the suspending part, the ceiling fan body has a plurality of horizontally-provided blades, a motor that rotates the blades, a shaft protruding from an upper side of the motor, and a joint part that is fixed to an upper side of the shaft and is connected to the suspending part, and the joint part is detachable from the suspending part and, is provided with a suspension detecting part extending from the joint part to the suspending part, the suspension detecting part detecting an energized state between the suspending part and the joint part.

A trial operation is made by fixing the suspending part to the ceiling and suspending the ceiling fan body from the suspending part. By using the suspension detecting part, it is easily confirmed that the ceiling fan body is properly installed when the ceiling fan rotates, and the ceiling fan body is not properly installed when the ceiling fan does not rotate.

DESCRIPTION OF EMBODIMENTS

A ceiling fan in accordance with an embodiment of the present invention will be described with reference to appended figures.

(Embodiment)

Figure 1:
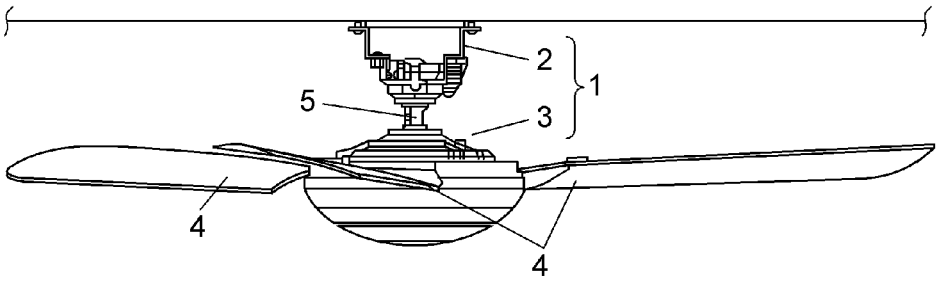
FIG. 1 is a schematic view of a ceiling fan in accordance with an embodiment of the present invention.
Figure 2:
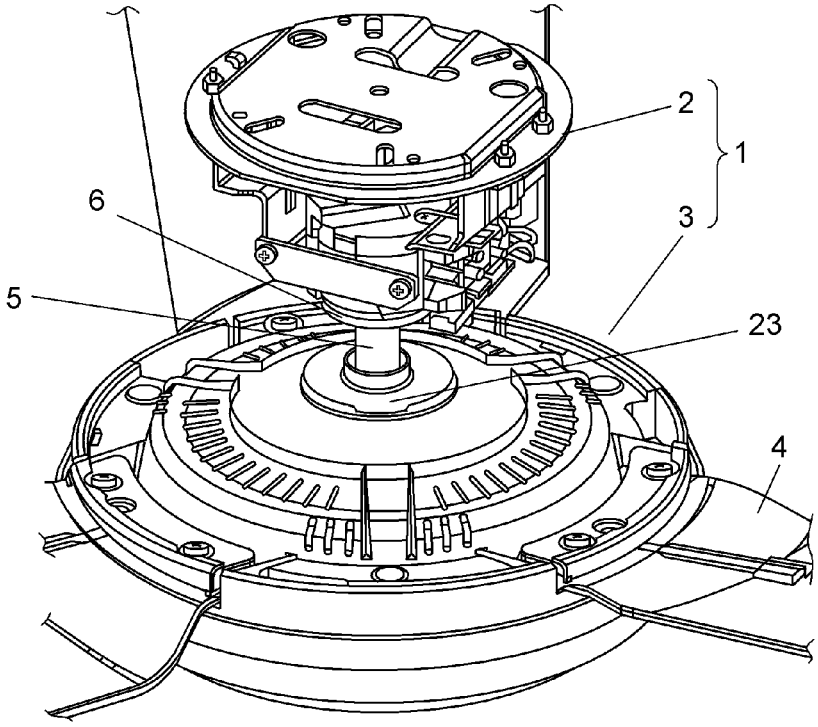
FIG. 2 is a detailed view of a suspending part and a ceiling fan body of the ceiling fan.

FIG. 1 is a schematic view of a ceiling fan in accordance with an embodiment of the present invention, and FIG. 2 is a detailed view of a suspending part and a ceiling fan body of the ceiling fan. As shown in FIG. 1 and FIG. 2, ceiling fan 1 includes suspending part 2 fixed to a ceiling, and ceiling fan body 3 suspended via suspending part 2.

Ceiling fan body 3 includes motor 23, a plurality of blades 4 provided in parallel to an edge of motor 23, shaft 5 protruding from an upper side of motor 23, and joint part 6 that is fixed to an upper side of shaft 5 and is connected to suspending part 2. Joint part 6 can be detachable from suspending part 2. Motor 23 rotates the plurality of blades 4.

In installing ceiling fan 1, first, suspending part 2 is fixed to the ceiling and then, joint part 6 of ceiling fan body 3 is attached to suspending part 2. In ceiling fan 1, motor 23 rotates, thereby rotating blades 4 to send air.

Figure 3:
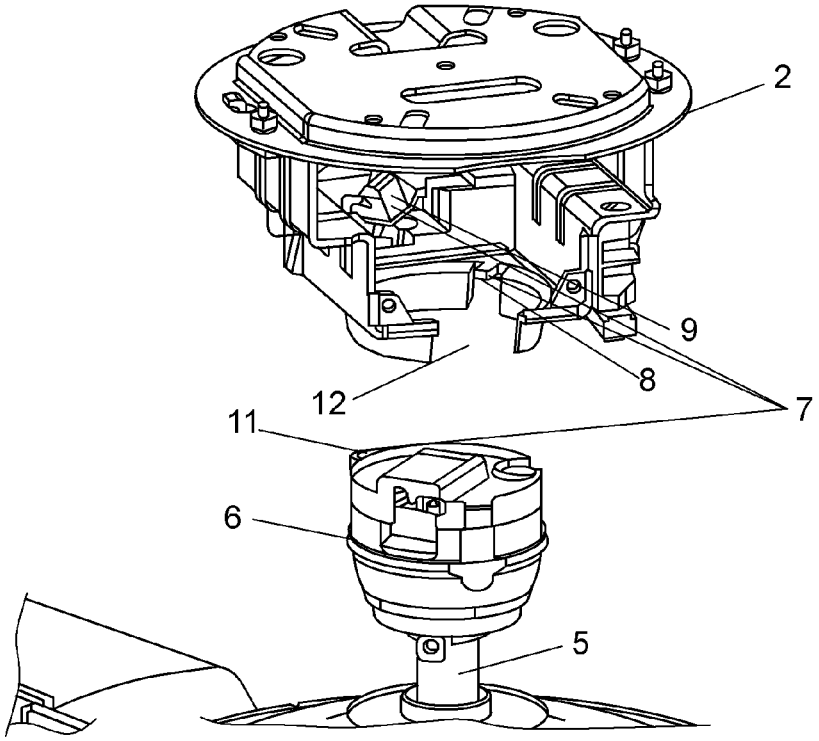
FIG. 3 is an exploded perspective view of the suspending part and a joint part of the ceiling fan.
Figure 4:
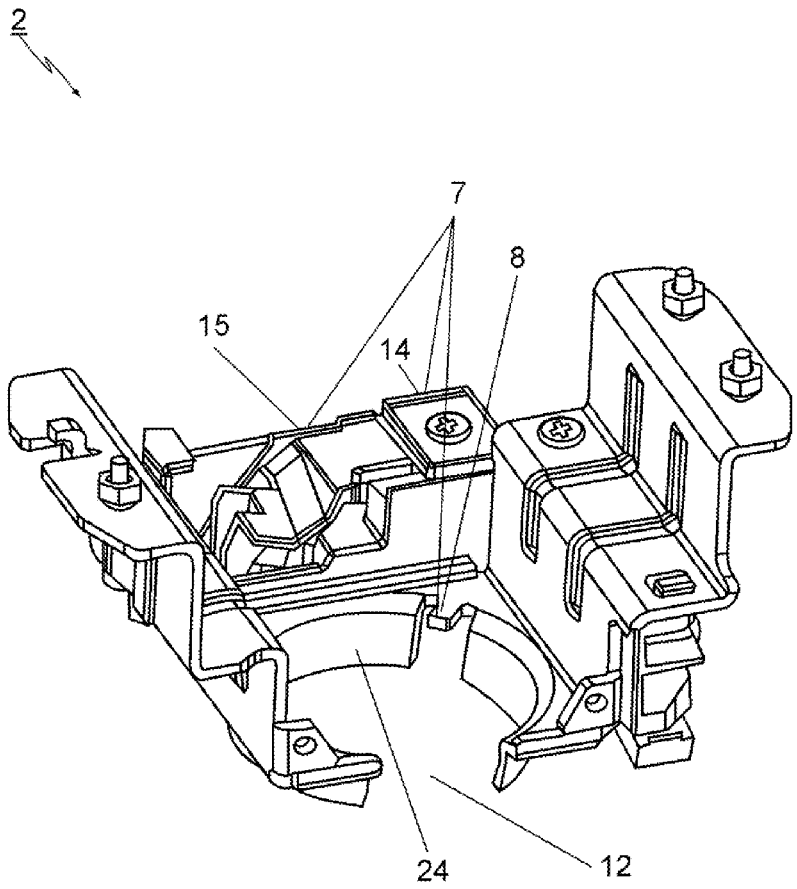
FIG. 4 is a partial perspective view of the suspending part of the ceiling fan.
Figure 5:
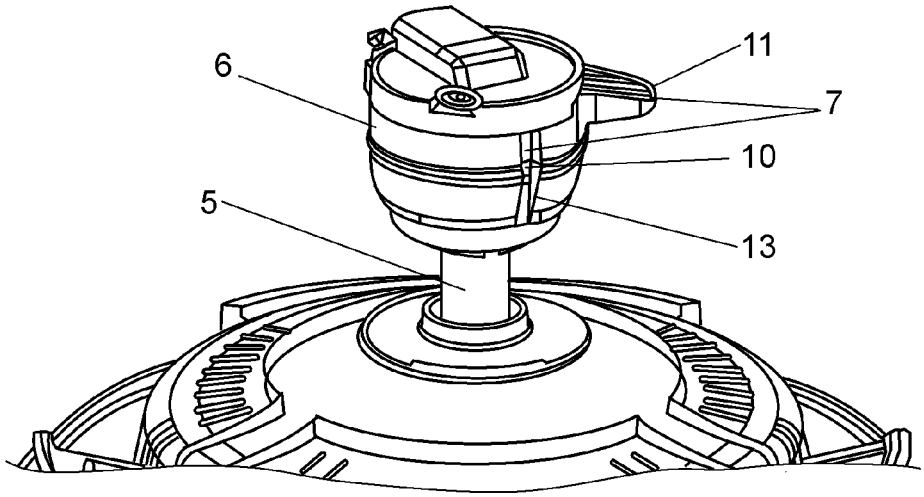
FIG. 5 is a perspective view of the joint part of the ceiling fan.

FIG. 3 is an exploded perspective view of the suspending part and the joint part of the ceiling fan in accordance the embodiment of the present invention, FIG. 4 is a partial perspective view of the suspending part of the ceiling fan, and FIG. 5 is a perspective view of the joint part of the ceiling fan. As shown in FIG. 3 to FIG. 5, suspension detecting part 7 extending from joint part 6 to suspending part 2 is provided. When joint part 6 is properly suspended from suspending part 2, suspension detecting part 7 is put into an energized state. That is, suspension detecting part 7 detects the energized state between suspending part 2 and joint part 6.

Suspension detecting part 7 includes protrusion 8 and power ON/OFF part 9 that are provided in suspending part 2, and groove 10 and pressing part 11 that are provided in joint part 6. As shown in FIG. 5, joint part 6 is substantially hemispherical. The upper side of joint part 6 has pressing part 11 as a substantially flat-plate like projection horizontally extending from an upper surface of joint part 6. A side surface of joint part 6 has the groove 10 shaped in a substantially vertically long rectangle.

As shown in FIG. 4, joint part holding part 24 of suspending part 2 is almost bowl-like. Joint part holding part 24 movably holds joint part 6. Suspending part 2 is further provided with notch 12 that can pass shaft 5 therethrough and protrusion 8 of plate-like shape protruding toward the inside of notch 12. The protrusion 8 is insertable into groove 10 of joint part 6. The protrusion 8 is inserted into groove 10, thereby bringing pressing part 11 into contact with power ON/OFF part 9, making power ON/OFF part 9 into the energized state.

In this manner, suspending part 2 is fixed to the ceiling, and ceiling fan body 3 is suspended from suspending part 2. Next, a trial operation can confirm whether or not ceiling fan body 3 is properly installed at suspending part 2.

That is, ceiling fan body 3 is suspended from suspending part 2, and power is supplied thereto. At this time, if blades 4 do not rotate, this means that ceiling fan body 3 is not properly installed at suspending part 2. In this manner, by using suspension detecting part 7, it can be reliably confirmed whether or not ceiling fan body 3 is correctly suspended from suspending part 2.

Figure 6:
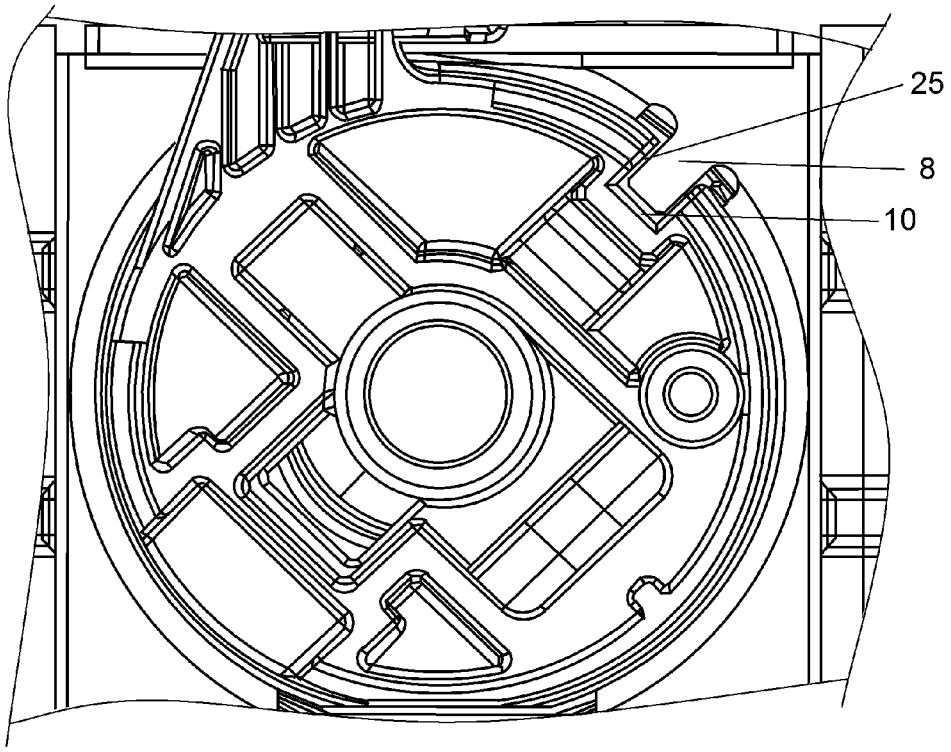
FIG. 6 is a plan view showing a state where a protrusion is inserted into a groove of the ceiling fan.

Next, a method of stopping ceiling fan body 3 when an irregular operation occurs during the operation of ceiling fan 1 will be described. FIG. 6 is a plan view showing a state where the protrusion is inserted into the groove of the ceiling fan in accordance with the embodiment of the present invention. As shown in FIG. 6, during the operation of ceiling fan 1, the protrusion 8 is inserted into groove 10 with gap 25. Since gap 25 exists between groove 10 and the protrusion 8, the almost hemispherical joint part 6 is movably suspended from suspending part 2. For this reason, in the case where any of blades 4 is irregularly attached, or any of blades 4 is deformed, when ceiling fan 1 is operated, joint part 6 repeatedly moves and ceiling fan body 3 swings. Then, joint part 6 rotates backward in the horizontal direction with respect to a rotating direction of motor 23, resulting in that angled part 13 where an inner surface of groove 10 of joint part 6 intersects with an outer circumferential surface of joint part 6 comes into contact with an end surface of the protrusion 8. As a result, angled part 13 comes into contact with the end surface of the protrusion 8 in FIG. 4, thereby scraping or breaking the protrusion 8, resulting in separation of pressing part 11 in FIG. 3 from power ON/OFF part 9. That is, making power ON/OFF part 9 into a non-energized state.

As described above, when the irregular operation such as swinging of ceiling fan body 3 occurs, angled part 13 strongly comes into contact with the end surface of the protrusion 8. Here, since contact surfaces are angled part 13 and the end surface of the protrusion 8, a contact area is small. Accordingly, frictional force is also small, and when swinging of ceiling fan body 3 occurs, in suspending part 2, joint part 6 can be moved more smoothly.

In the case where ceiling fan 1 is operating with blades 4 being irregularly attached, when swinging of ceiling fan body 3 occurs, angled part 13 is in point-contact with the end surface of the protrusion 8 by the swinging. That is, angled part 13 wears itself as well as the end surface of the protrusion 8 by a vertical moving distance of the protrusion 8.

As an example, joint part 6 is formed by adding a glass fiber to Nylon 66 (registered trademark). This glass fiber can improve the movability of joint part 6 with respect to suspending part 2 and scrape metal. Thus, the protrusion 8 is scraped or broken.

As described above, when any of blades 4 is irregularly attached or deformed, swinging during operation of ceiling fan 1 is sensed with blades 4 being deformed. Then, the protrusion 8 is scraped or broken, resulting in the pressing part 11 being separated from power ON/OFF part 9 to stop the operation of motor 23. When ceiling fan body 3 is suspended in the state where the protrusion 8 is not inserted into groove 10, the protrusion 8 is inserted into groove 10 as follows. That is, a part of joint part 6 enters the substantially bowl-like suspending part 2, and joint part 6 is moved to the upper part of suspending part 2. Next, groove 10 is matched with the protrusion 8, and joint part 6 is moved downward.

Here, when joint part 6 is moved downward in the case where groove 10 is not matched with the protrusion 8, the protrusion 8 is inserted into groove 10 as follows. The protrusion 8 provided in suspending part 2 comes into contact with an outer spherical circumference of joint part 6, assuming a temporary suspending state of ceiling fan body 3. When joint part 6 is manually rotated in the temporary suspending state, groove 10 is matched with the protrusion 8, so that the protrusion 8 is inserted into groove 10, and ceiling fan body 3 is properly suspended. Since groove 10 is vertically formed and the protrusion 8 protrudes toward the inside of notch 12, the protrusion 8 is reliably inserted into groove 10 by the rotation of joint part 6.

A front end of the protrusion 8 is substantially arcuate. In the temporary suspending state of ceiling fan body 3, a front end of the protrusion 8 comes into contact with the outer spherical circumference of joint part 6. Since the front end of the protrusion 8 is substantially arcuate, joint part 6 can be easily rotated.

Figure 7:
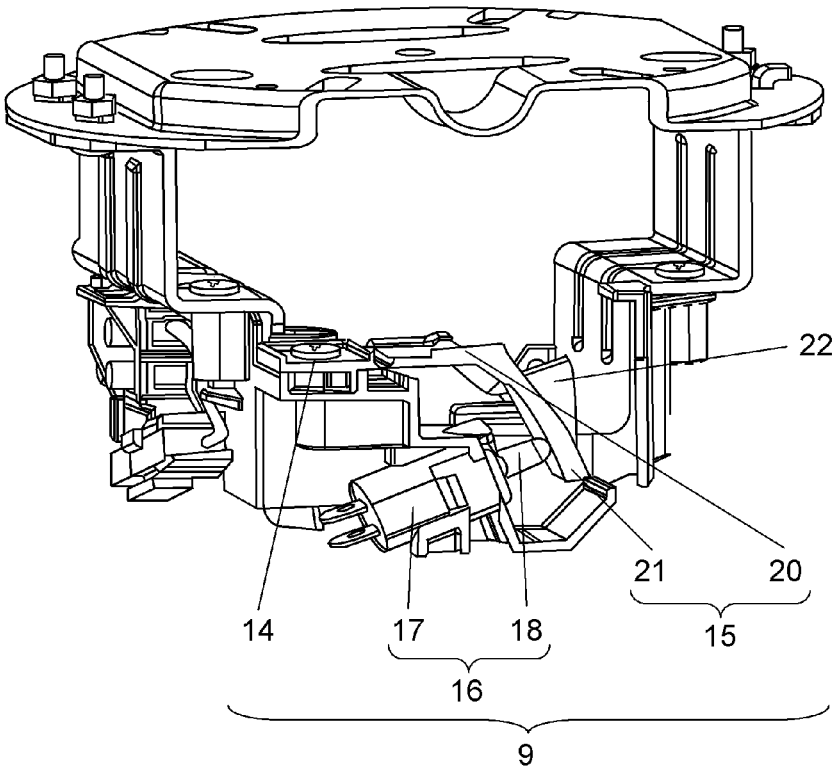
FIG. 7 is a detailed perspective view of the suspending part of the ceiling fan.
Figure 8:
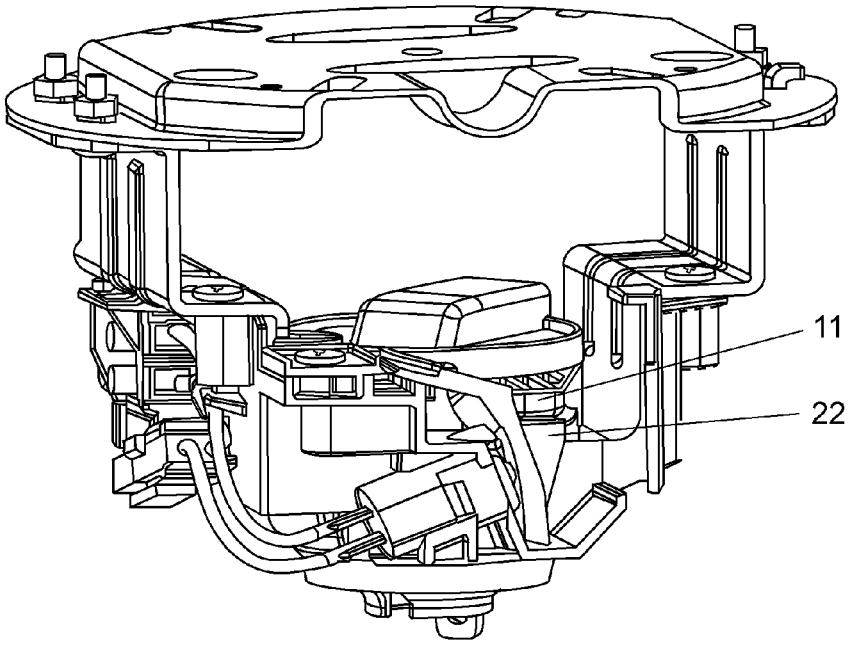
FIG. 8 is a detailed perspective view of the suspending part and the joint part of the ceiling fan.

FIG. 7 is a detailed perspective view of the suspending part of the ceiling fan in accordance with the embodiment of the present invention, and FIG. 8 is a detailed perspective view of the suspending part and the joint part of the ceiling fan. As shown in FIG. 7 and FIG. 8, power ON/OFF part 9 includes fixed part 14 fixed to suspending part 2 with a screw, movable part 15 that extends from fixed part 14 in a substantially horizontal direction and can rotate in a substantially vertical direction, and switch part 16.

Movable part 15 includes first flat plate part 20 extending from fixed part 14 in the horizontal direction, and second flat plate part 21 extending from a front end of first flat plate part 20 in the vertically downward direction.

Switch part 16 is fixed to a lower side of fixed part 14 in the substantially horizontal direction. Switch part 16 is pressed by second flat plate part 21 to be energized. Switch part 16 includes a substantially columnar switch body 17 incorporating a contact, and a substantially columnar switch protruding part 18 that extends from switch body 17 and can freely appear. Here, by suspending ceiling fan body 3 such that the protrusion 8 is inserted into groove 10, pressing part 11 comes into contact with movable part 15, thereby pushing movable part 15 downward. Movable part 15 lowers while rotating in the vertical downward direction, and second flat plate part 21 presses switch protruding part 18 to a predetermined position in switch body 17. That is, by pressing switch protruding part 18 to the predetermined position in switch body 17, the contact built in switch body 17, that is, switch part 16 is energized, and power ON/OFF part 9 is put into the energized state. An example of switch part 16 is a push-on switch.

First flat plate part 20 and second flat plate part 21 convert a force to press pressing part 11 downward into a force in the substantially horizontal direction. Thereby, since switch part 16 is attached in the substantially horizontal direction, protrusion of switch part 16 is suppressed.

A plurality of perpendicular surface parts 22 extending perpendicular to second flat plate part 21 are provided. Ends of perpendicular surface part 22 are in contact with pressing part 11.

Movable part 15 may be formed of first flat plate part 20, second flat plate part 21, and the flat-plate like perpendicular surface parts 22. The ends of perpendicular surface part 22 are in contact with a lower surface of pressing part 11, and the lower surface of pressing part 11 pushes movable part 15 downward via the ends of perpendicular surface part 22.

Movable part 15 lowers while rotating around a coupling part of fixed part 14 and first flat plate part 20 in the vertical downward direction. Further, switch protruding part 18 is pressed to the predetermined position in switch body 17. Here, since perpendicular surface part 22 also lower while rotating in the vertical downward direction, the ends of perpendicular surface part 22 move while sliding on the lower surface of pressing part 11. That is, a contact part of movable part 15 and fixed part 14 is the ends of perpendicular surface part 22, and the contact area is small. For this reason, movable part 15 is lowered while smoothly rotating in the vertical downward direction.

Fixed part 14 and movable part 15 are made of resin. A rotating center of movable part 15 is shaped into a hinge. That is, a rotating center of movable part 15 as the coupling part with first flat plate part 20 is shaped like a hinge. Thus, the rotating shaft is made without using a new shaft.

INDUSTRIAL APPLICABILITY

As described above, the ceiling fan of the present invention can reliably confirm whether or not the ceiling fan body is properly suspended from the suspending part by means of the suspension detecting part. Therefore, the ceiling fan is effective as ceiling fans for households and offices.

REFERENCE MARKS IN THE DRAWINGS

1 ceiling fan
2 suspending part
3 ceiling fan body
4 blade
5 shaft
6 joint part
7 suspension detecting part
8 protrusion
9 power ON/OFF part
10 groove
11 pressing part
12 notch
13 angled part
14 fixed part
15 movable part
16 switch part
17 switch body
18 switch protruding part
20 first flat plate part
21 second flat plate part
22 perpendicular surface part
23 motor
24 joint part holding part
25 gap

The invention claimed is:

1. A ceiling fan comprising:
a suspending part fixed to a ceiling; and
a ceiling fan body suspended via the suspending part, wherein the ceiling fan body includes
a plurality of horizontally-provided blades,
a motor rotating the blades,
a shaft protruding from an upper side of the motor, and
a joint part fixed to an upper side of the shaft, the joint part being connected to the suspending part and detachable from the suspending part,
wherein the suspending part includes a protrusion and a power ON/OFF part,
wherein the joint part includes a groove and a pressing part,
wherein an energized state between the suspending part and the joint part can be detected by engagement between the protrusion and the groove,
wherein the joint part has a hemispherical surface and includes the groove in the hemispherical surface,
the suspending part is bowl-like, can movably hold the joint part and has a notch capable of passing the shaft therethrough,
the protrusion has a plate-like shape and is capable of being inserted into the groove,
by inserting the protrusion into the groove, the pressing part comes into contact with the ower ON/OFF part to cause the energized state,
when the protrusion is inserted into the groove, a gap is provided between the protrusion and the groove, and
during horizontal rotation of the joint part, an angled part where an inner surface of the groove intersects with an outer circumferential surface of the joint part comes into contact with an end surface of the protrusion, thereby scraping or breaking the protrusion, resulting in separation of the pressing part from the power ON/OFF part and thus causing a non-energized state between the suspending part and the joint part.

2. The ceiling fan according to claim 1, wherein the groove is vertically formed, and the protrusion protrudes toward the inside of the notch.

3. The ceiling fan according to claim 2, wherein a front end of the protrusion is arcuate.

4. A ceiling fan comprising:
a suspending part fixed to a ceiling; and
a ceiling fan body suspended via the suspending part, wherein the ceiling fan body includes
a plurality of horizontally-provided blades,
a motor rotating the blades,
a shaft protruding from an upper side of the motor, and
a joint part fixed to an upper side of the shaft, the joint part being connected to the suspending part and detachable from the suspending part,
wherein the suspending part includes a protrusion and a power ON/OFF part,
wherein the joint part includes a groove and a pressing part,
wherein an energized state between the suspending part and the joint part can be detected by engagement between the protrusion and the groove,
the joint part has a hemispherical surface and includes the groove in the hemispherical surface,
the suspending part is bowl-like, can movably hold the joint part and has a notch capable of passing the shaft therethrough, and
the protrusion has a plate-like shape and is capable of being inserted into the groove, and
by inserting the protrusion into the groove, the pressing part comes into contact with the power ON/OFF part to cause the energized state,
wherein the power ON/OFF part includes
a fixed part fixed to the suspending part,
a movable part capable of rotating from the fixed part in the vertical direction, and
a switch part,
the movable part includes
a first flat plate part extending from the fixed part in the horizontal direction, and
a second flat plate part extending from a front end of the first flat plate part in the vertical downward direction, and
the switch part is pressed by the second flat plate part to be energized.

5. The ceiling fan according to claim 4, wherein a plurality of perpendicular surface parts extending perpendicularly from the second flat plate part are provided, and ends of the perpendicular surface parts are in contact with the pressing part.

6. The ceiling fan according to claim 5, wherein the fixed part and the movable part are made of resin, and a rotational center of the movable part is shaped into a hinge.

7. A ceiling fan comprising:
a suspending part fixed to a ceiling, the suspending part including a protrusion and a power ON/OFF part; and
a ceiling fan body suspended via the suspending part, wherein the ceiling fan body includes:

a motor rotating a plurality of blades, a shaft protruding from an upper side of the motor, and a joint part fixed to the shaft, the joint part being connected to the suspending part and including a groove and a pressing part, wherein the protrusion has a plate-like shape and is configured to be inserted into the groove so that the pressing part comes into contact with the power ON/OFF part to cause an energized state between the suspending part and the joint part, the power ON/OFF part includes a fixed part fixed to the suspending part, a movable part capable of rotating from the fixed part in the vertical direction, and a switch part, the movable part includes a first flat plate part extending from the fixed part in the horizontal direction, and a second flat plate part extending from a front end of the first flat plate part in the vertical downward direction, the switch part is pressed by the second flat plate part to generate the energized state, the joint part has a hemispherical surface and includes the groove in the hemispherical surface, and the suspending part is bowl-like, can movably hold the joint part and has a notch capable of passing the shaft therethrough.

* * * * *